US008246202B2

(12) United States Patent
Mart et al.

(10) Patent No.: US 8,246,202 B2
(45) Date of Patent: Aug. 21, 2012

(54) LIGHT EMITTING DIODE BULB

(76) Inventors: Gary K. Mart, Naples, FL (US); Jeffrey Newman, Coral Springs, FL (US)

( * ) Notice: Subject to any disclaimer, the term of this patent is extended or adjusted under 35 U.S.C. 154(b) by 0 days.

(21) Appl. No.: 12/371,257

(22) Filed: Feb. 13, 2009

(65) Prior Publication Data

US 2009/0200908 A1 Aug. 13, 2009

Related U.S. Application Data

(60) Provisional application No. 61/028,396, filed on Feb. 13, 2008.

(51) Int. Cl.
*F21S 4/00* (2006.01)

(52) U.S. Cl. ..... 362/249.02; 362/249.01

(58) Field of Classification Search ..... 362/227, 362/249.01, 249.02, 294, 345, 362, 373, 362/543–549, 649, 650, 800
See application file for complete search history.

(56) References Cited

U.S. PATENT DOCUMENTS

| | | | | |
|---|---|---|---|---|
| 4,638,970 | A | 1/1987 | Phelan | |
| 4,931,917 | A | 6/1990 | Scherf et al. | |
| 6,793,374 | B2 * | 9/2004 | Begemann | 362/294 |
| 6,864,513 | B2 * | 3/2005 | Lin et al. | 257/99 |
| 7,144,135 | B2 * | 12/2006 | Martin et al. | 362/294 |
| 7,144,140 | B2 * | 12/2006 | Sun et al. | 362/373 |
| 7,524,089 | B2 * | 4/2009 | Park | 362/294 |
| 7,549,774 | B2 * | 6/2009 | Tsai | 362/294 |
| 7,682,054 | B2 * | 3/2010 | Hsu et al. | 362/373 |
| 2003/0133305 | A1 | 7/2003 | Chen | |
| 2005/0174780 | A1 | 8/2005 | Park | |
| 2005/0254246 | A1 * | 11/2005 | Huang | 362/362 |
| 2006/0262545 | A1 | 11/2006 | Piepgras et al. | |

OTHER PUBLICATIONS

International Search Report from corresponding PCT Application No. PCT/US09/46641.

* cited by examiner

*Primary Examiner* — Hargobind S Sawhney
(74) *Attorney, Agent, or Firm* — Lowe Hauptman Ham & Berner, LLP

(57) ABSTRACT

A light emitting diode-based bulb is described. The bulb comprises a base comprising a driver; and a housing releasably coupled with the base. The housing comprises a light emitting diode connected to the driver and a fan connected to the driver.

18 Claims, 10 Drawing Sheets

LIGHT EMITTING DIODE BULB

BACKGROUND

Present approaches for light emitting diode-based (LED-based or simply LED) light bulbs require a user to either replace an entire bulb which malfunctions, e.g., "burns out" or degrades in performance, or send the malfunctioning bulb to a service center for repair. Additionally, servicing such malfunctioning bulbs requires opening the bulb and removing thermal transfer and/or insulating material, often in the form of a semi-solid liquid such as a grease or other material, from the interior of the bulb and requiring multiple tools.

DESCRIPTION OF THE DRAWINGS

One or more embodiments are illustrated by way of example, and not by limitation, in the figures of the accompanying drawings, wherein elements having the same reference numeral designations represent like elements throughout and wherein.

DETAILED DESCRIPTION

Figure 1:
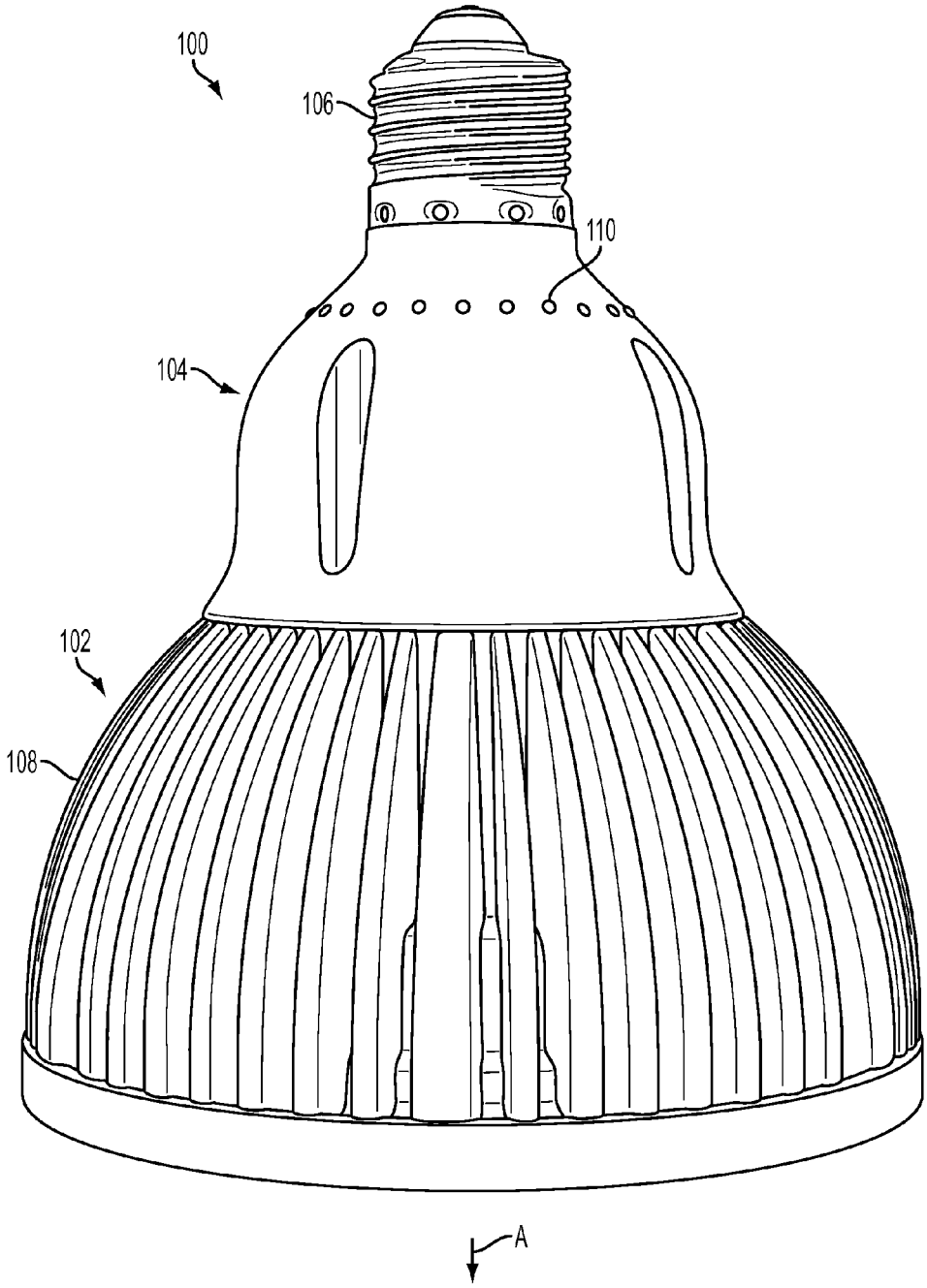
FIG. 1 is a side view of an LED bulb according to an embodiment.

FIG. 1 depicts a side view of an LED bulb 100 according to an embodiment of the present invention. Bulb 100 comprises a housing 102 operatively coupled with a base 104. Housing 102 is hemispherically-shaped and base 104 is bell-shaped. In at least some alternative embodiments, housing 102 and base 104 may comprise different shapes and sizes. Housing 102 is formed of metal, e.g., aluminum, etc. In at least some embodiments, housing 102 may comprise a plastic or other lightweight material. Base 104 is formed of plastic; however, other materials may be used, e.g., metal. In differing embodiments, bulb 100 may comprise different sizes, shapes, and/or profiles, e.g., a BR40, BR30, BR20, PAR16, PAR20, PAR30, PAR38 and other configurations.

Housing 102 comprises one or more LED units 200 (FIG. 2) arranged to generate light in a direction (generally indicated by reference A) away from the housing and base 104. Base 104 comprises a power connector 106 for connecting bulb 100 to a power connection, e.g., a receiving socket such as a light socket or other connection mechanism, and powering, via internal connections, LED unit 200. In use, power connector 106 of bulb 100 is screwed into a receiving socket to receive and provide power to the LED unit 200 and thereby generate light.

Housing 102 also comprises a set of vanes 108 arranged circumferentially-spaced about the housing for dissipating heat generated by bulb 100. Each vane 108 extends longitudinally along housing 102 from an end near base 104 toward a distal end of the housing. In at least some embodiments, housing 102 does not comprise vanes 108.

Base 104 comprises a set of rear passages 110 configured to permit a flow of air between the interior and exterior of bulb 100. Rear passages 110 are radially disposed around base 104 and surrounding power connector 106. In at least some embodiments, rear passages 110 may be different sizes and shapes, e.g., circular, oval, rectangular, polygonal, etc.

Further, in at least some embodiments, base 104 may comprise a greater or lesser number of rear passages. In at least some embodiments, rear passages 110 may be disposed at a different location on base 104, e.g., semi-circularly around power connector 106. In at least one alternative embodiment, housing 102 may comprise one or more rear passages 110 in addition to or in place of the rear passages of base 104.

As depicted in FIG. 1, power connector 106 comprises a PAR38 connector. In differing embodiments, power connector 106 comprises a different connector, e.g., a GU24, GU10, E11, E12, E17, E26, MR16, MR11, etc. Power connector 106 is attached to base 104 by crimping a perimeter of the connector. In at least some embodiments, different mechanisms may be used to connect power connector 106 to base 104. In at least one embodiment, power connector 106 is formed as an integral part of base 104.

Base 104 is removably coupled with housing 102. Base 104 is operatively coupled with housing 102 by one or more removable attaching devices, e.g., screws, bolts, clips, etc. In at least one embodiment, base 104 is operatively coupled with housing 102 by a twist-lock or bayonet-type mount. In at least some embodiments, base 104 is operatively coupled with housing 102 by a reverse threaded screw mount. In at least some embodiments, different releasable mounting mechanisms may be used to connect base 104 with housing 102. For example, in some embodiments, base 104 is operatively coupled with housing 102 by use of a snap mechanism.

Figure 2:
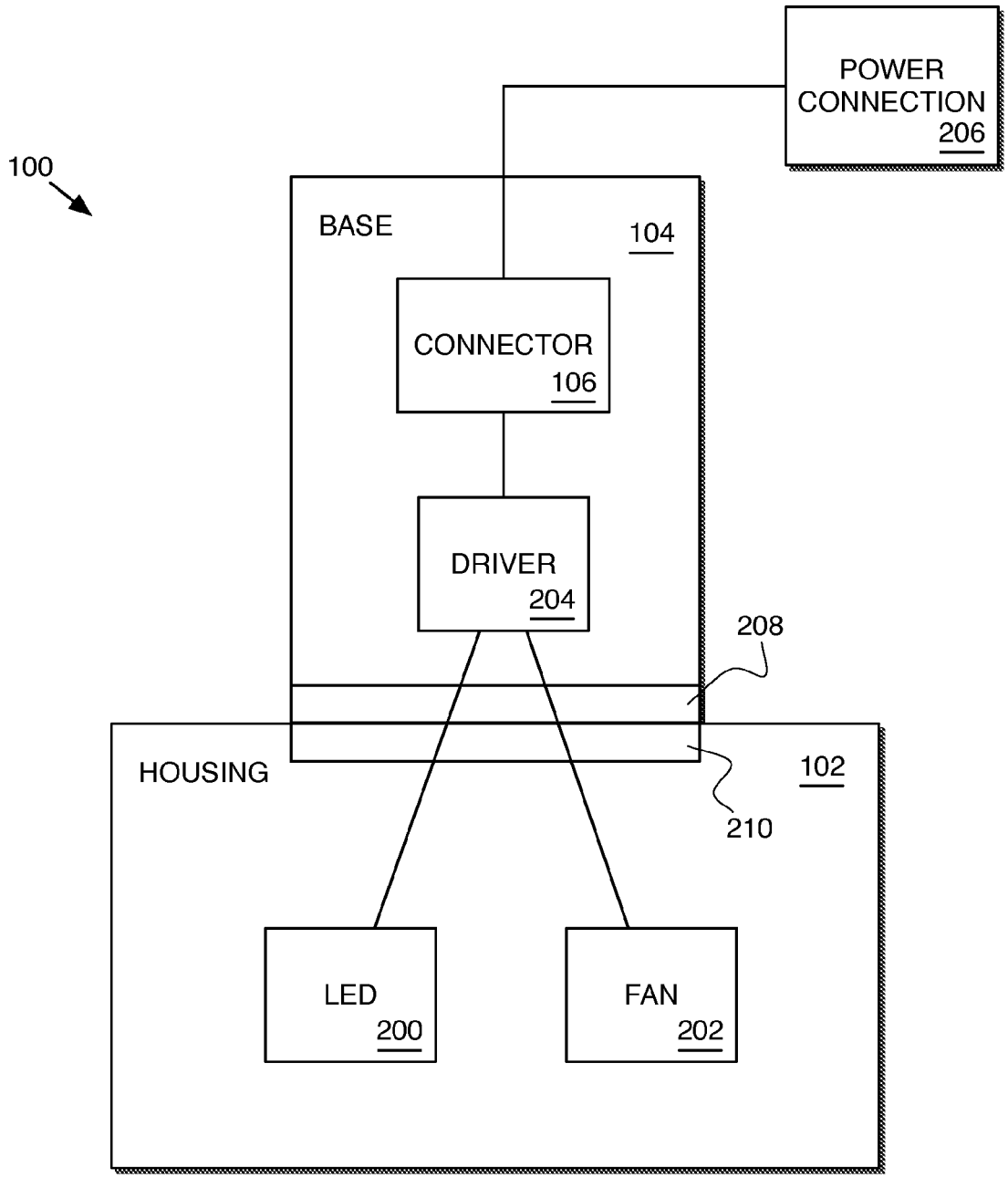
FIG. 2 is a high-level functional block diagram of an LED bulb according to an embodiment.

FIG. 2 depicts a high-level functional block diagram of bulb 100 comprising housing 102 and base 104. Housing 102 comprises an LED unit 200, e.g., LED circuit, etc., and a fan 202. LED unit 200 and fan 202 are operatively and electrically coupled to a driver 204 in base 104.

In at least some embodiments, LED unit 200 and fan 202 are electrically coupled to a single connection to driver 204. For example, in at least some embodiments, the electrical connection between driver 204 and LED unit 200 and fan 202 comprises a single plug connection. The single plug connection may be plugged and unplugged by a user without requiring the use of tools.

In at least some embodiments, housing 102 may comprise a greater number of LED units 200. In at least some embodiments, housing 102 may comprise a greater number of fans 202.

LED unit 200 generates light responsive to receipt of current from driver 204.

Fan 202 operates, i.e., rotates, responsive to receipt of current from driver 204. Rotation of fan 202 within housing 102 causes air to be drawn in through front vents 302 (FIG. 3) and expelled via rear vents 110. The flow of air through bulb 100 by rotation of fan 202 removes heat from the vicinity of LED unit 200 thereby reducing the temperature of the LED unit. Maintaining LED unit 200 below a predetermined temperature threshold maintains the functionality of LED unit 200. In at least some embodiments, LED unit 200 is negatively affected, e.g., as in reduced lifespan, by operation at a temperature exceeding the predetermined temperature threshold. In at least some embodiments, the number of rear vents 110 is dependent on the amount of air flow needed through the interior of LED bulb 100 to maintain the temperature below the predetermined threshold. In at least some embodiments, fan 202 may be replaced by one or more cooling devices arranged to keep the temperature below the predetermined temperature threshold. For example, in some embodiments, fan 202 may be replaced by a movable membrane or a diaphragm or other similar powered cooling device.

In at least some embodiments, fan 202 is integrally formed as a part of housing 102. In at least some other embodiments, fan 202 is directly connected to housing 102. In still further embodiments, fan 202 is physically connected and positioned exclusively within housing 102.

Figure 3:
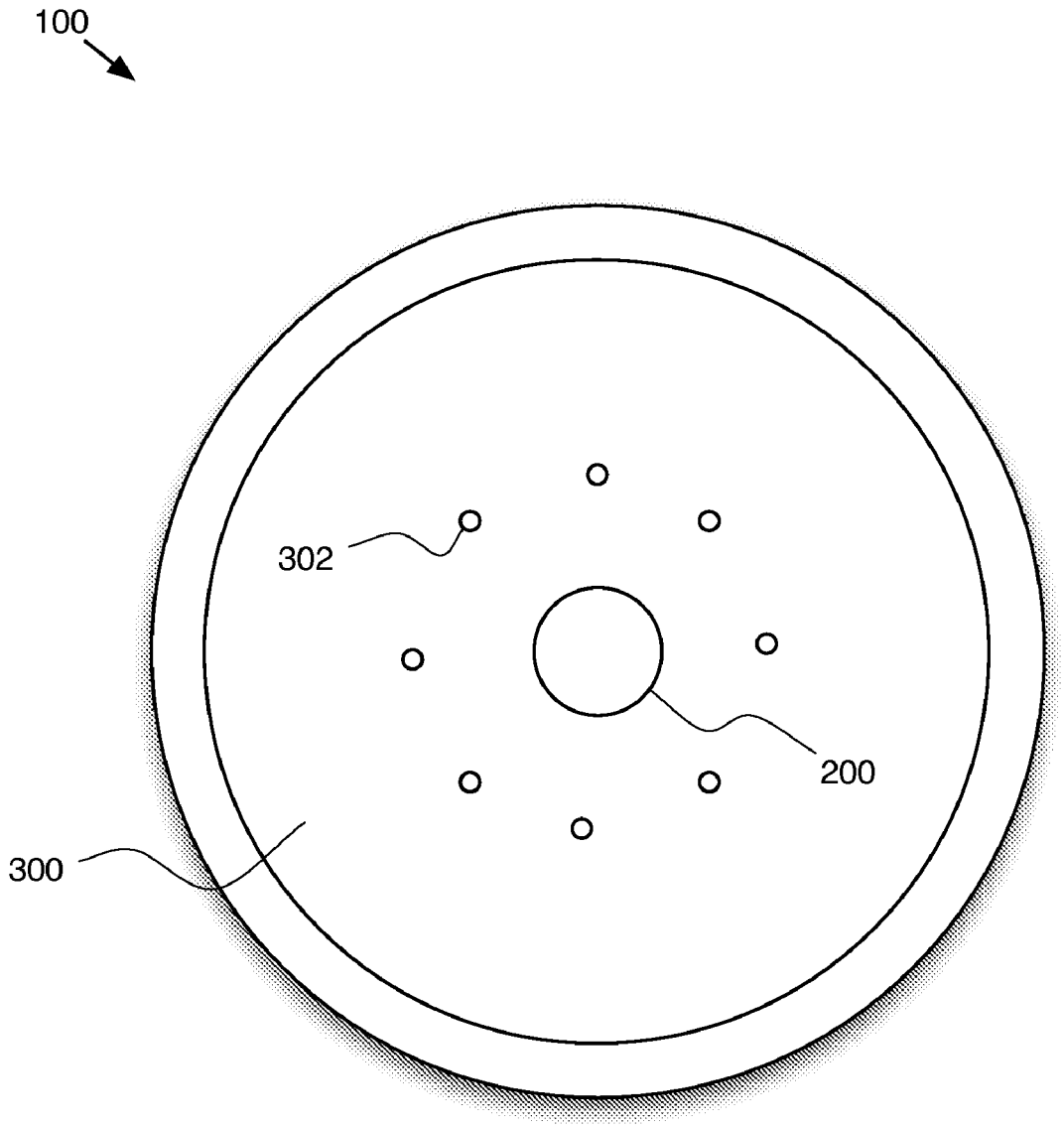
FIG. 3 is a front plan view of the front face of an LED bulb according to an embodiment.

In at least some embodiments, fan 202 may be operated at one or more rotational speeds. In at least some embodiments, fan 202 may be operated in a manner in order to draw air into bulb 100 via rear vents 110 and expel air through front vents 302 (FIG. 3). By using fan 202 in LED bulb 100, thermal insulating material and/or thermal transfer material need not be used to remove heat from the LED bulb interior.

Base 104 comprises connector 106 and a driver 204. Driver 204 comprises one or more electronic components to convert alternating current (AC) received from connector 106 connected to a power connection 206, e.g., a mains power supply or receiving socket, to direct current (DC). Driver 204 transmits the converted current to LED unit 200 and fan 202 in order to control operation of the LED unit and fan. In at least some embodiments, driver 204 is configured to provide additional functionality to bulb 100. For example, in at least some embodiments, driver 204 enables dimming of the light produced by bulb 100, e.g., in response to receipt of a different current and/or voltage from power connector 106.

In at least some embodiments, driver 204 is integrated as a part of base 104. In at least some embodiments, driver 204 is configured to receive a range of input voltage levels for driving components of housing 102, i.e., LED unit 200 and fan 202. In at least some embodiments, driver 204 is configured to receive a single input voltage level.

Base 104 also comprises a base releasable attachment device 208 and housing 102 also comprises a housing releasable attachment device 210 for removably attaching the base and housing to each other. In at least some embodiments, base releasable attachment device 208 is a screw. In at least some further embodiments, base releasable attachment device 208 is a bolt, a reverse threading, a portion of a twist-lock or bayonet mechanism.

In at least some embodiments, housing releasable attachment device 210 comprises a receptacle for receiving a screw or bolt. In at least some embodiments, housing releasable attachment device 210 is a mate for the base releasable attachment device 208, e.g., a reverse threading, a clip, or other mechanism.

In operation, if one or more LED units 200 in a particular housing 102 degrades or fails to perform, the entire LED bulb 100 need not be replaced. In such a situation, only housing 102 needs replacing. Conversely, if driver 204 fails or degrades in performance, only base 104 needs to be replaced. Because of the use of releasably coupled components, i.e., base 104 and housing 102, the replacement of one or the other of the components may be performed on location with minimal or no tools required by a user. That is, the user may remove LED bulb 100 from a socket, replace base 104 with a new base, and replace the LED bulb into the socket in one operation. Removal of LED bulb 100 to another location or transport of the LED bulb to a geographically remote destination for service is not needed.

Also, if the user desires to replace a particular driver 204 of a bulb 100, the user need only remove and replace the currently connected base 104 with a new base 104. For example, a user may desire to replace a non-dimmable base with a base which supports dimming. Also, a user may desire to replace a driver having a shorter lifespan with a driver having a longer lifespan. Alternatively, a user may desire to replace a base having a particular array of LED units 200 with a different selection of LED units 200, e.g., different colors, intensity, luminance, lifespan, etc.; the user need only detach base 104 from housing 102 and reattach the new base 104 to the housing 102.

FIG. 3 depicts a front plan view of front face 300 of LED bulb 100 comprising a plurality of front vents 302. Front vents 302 are radially disposed around LED unit 200. In one or more alternative embodiments, front vents 302 may be larger or smaller and there may be a greater or lesser number of front vents. In at least some embodiments, the number of front vents 302 is dependent on the amount of air flow needed through the interior of LED bulb 100 to maintain the temperature below the predetermined threshold.

In at least some embodiments, front vents 302 may be circular, oval, rectangular, or polygonal or another shape. Front vents 302 may also be slits or other shaped openings to the interior of housing 102. In at least some embodiments, front vents 302 may be formed as a part of the opening in front face 300 for LED unit 200.

Figure 4:
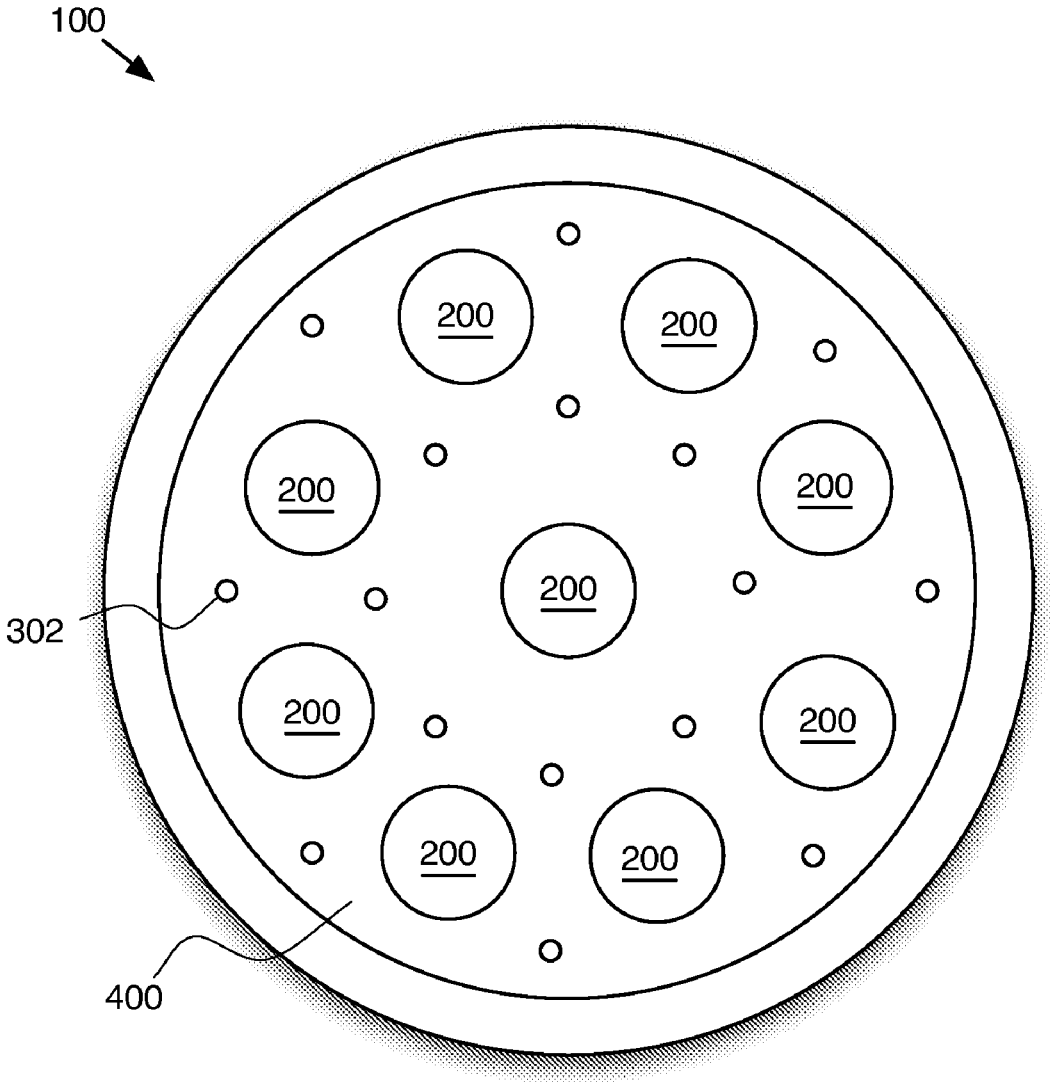
FIG. 4 is a front plan view of the front face of an LED bulb according to another embodiment.

FIG. 4 depicts a front plan view of front face 400 of LED bulb 100 according to another embodiment wherein the bulb comprises more than one LED unit 200. LED bulb 100 also comprises a plurality of front vents 302. Because of the greater number of LED units 200, there may be a greater number of front vents 302 or the front vents may be larger in size.

In at least some embodiments, LED units 200 may comprise different size, shape, and light-emitting characteristics.

Figure 5:
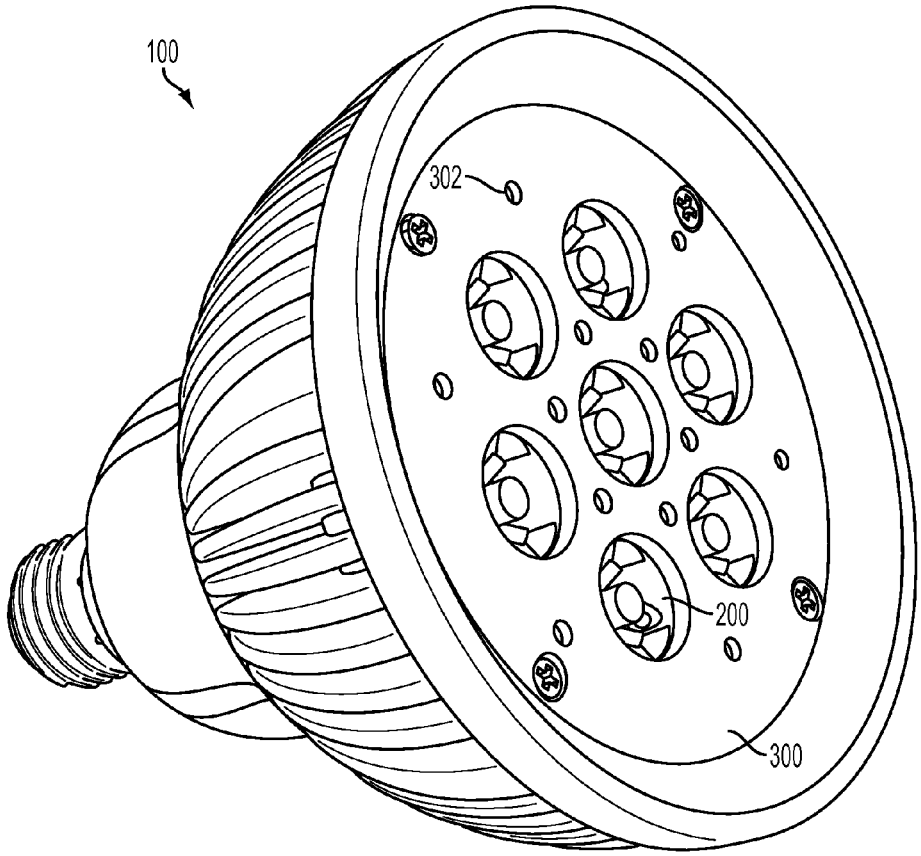
FIG. 5 is a front perspective view of an LED bulb according to an embodiment.

FIG. 5 depicts a front perspective view of LED bulb 100 according to an embodiment comprising seven (7) LED units 200.

Figure 6:
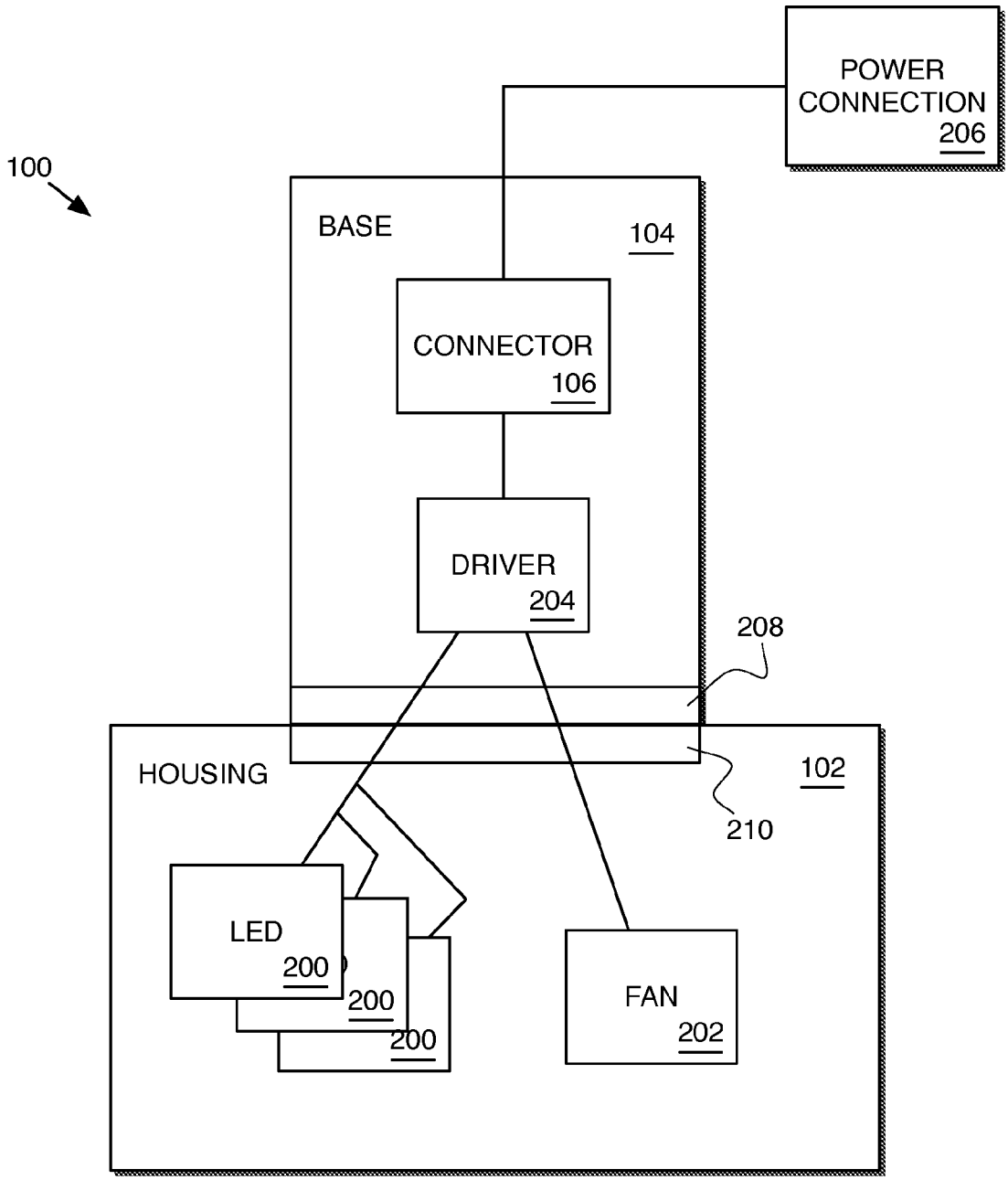
FIG. 6 is a high-level functional block diagram of an LED bulb according to another embodiment.

FIG. 6 depicts a high-level functional block diagram of LED bulb 100 according to another embodiment comprising three (3) LED units 200 in housing 102 along with fan 202.

Figure 7:
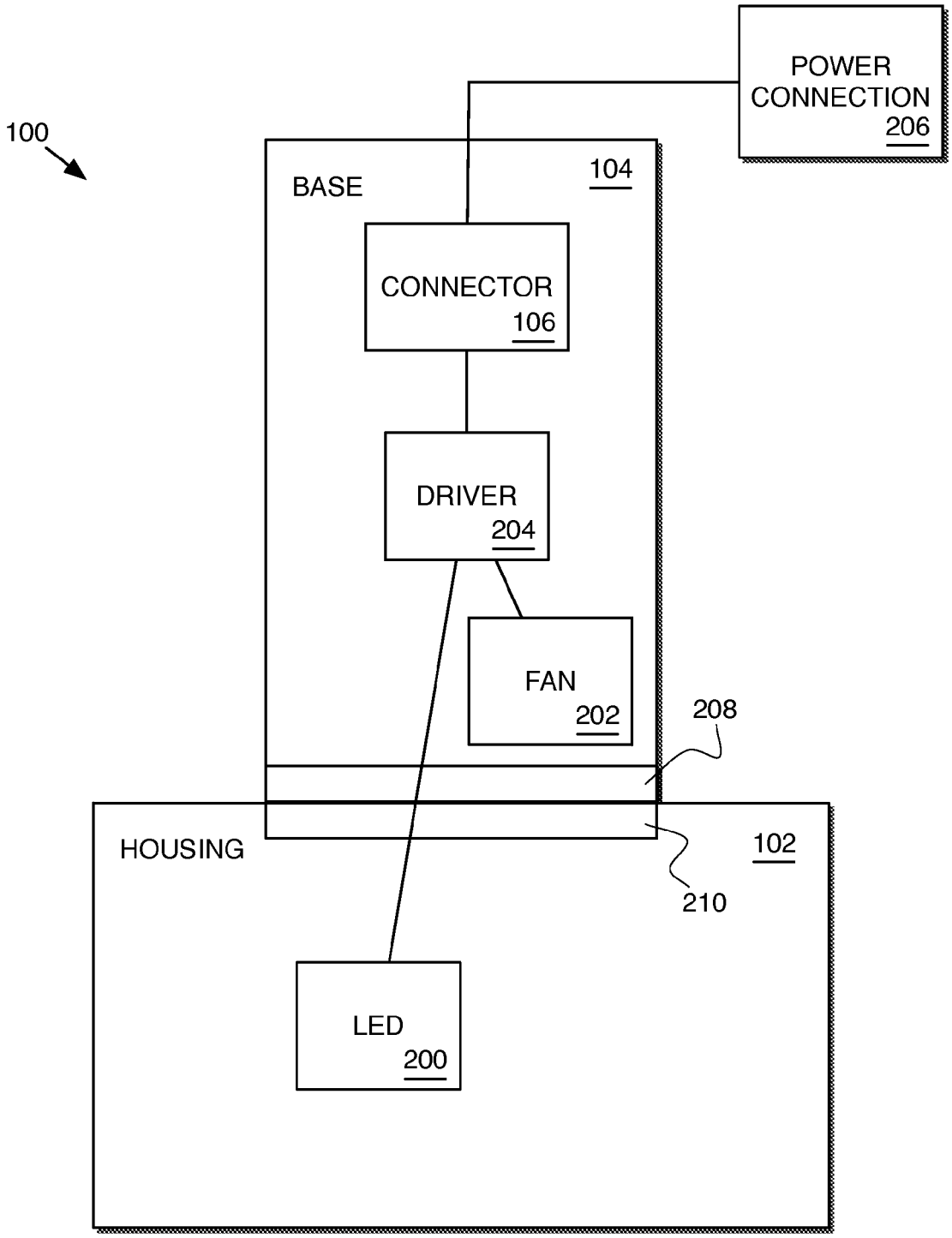
FIG. 7 is a high-level functional block diagram of an LED bulb according to another embodiment.

FIG. 7 depicts a high-level functional block diagram of LED bulb 100 according to another embodiment wherein fan 202 is positioned within base 104 instead of housing 102. In accordance with this embodiment, fan 202 may be directly connected with driver 204 or use a separate plug connection from LED 200 to connect with the driver.

Figure 8:
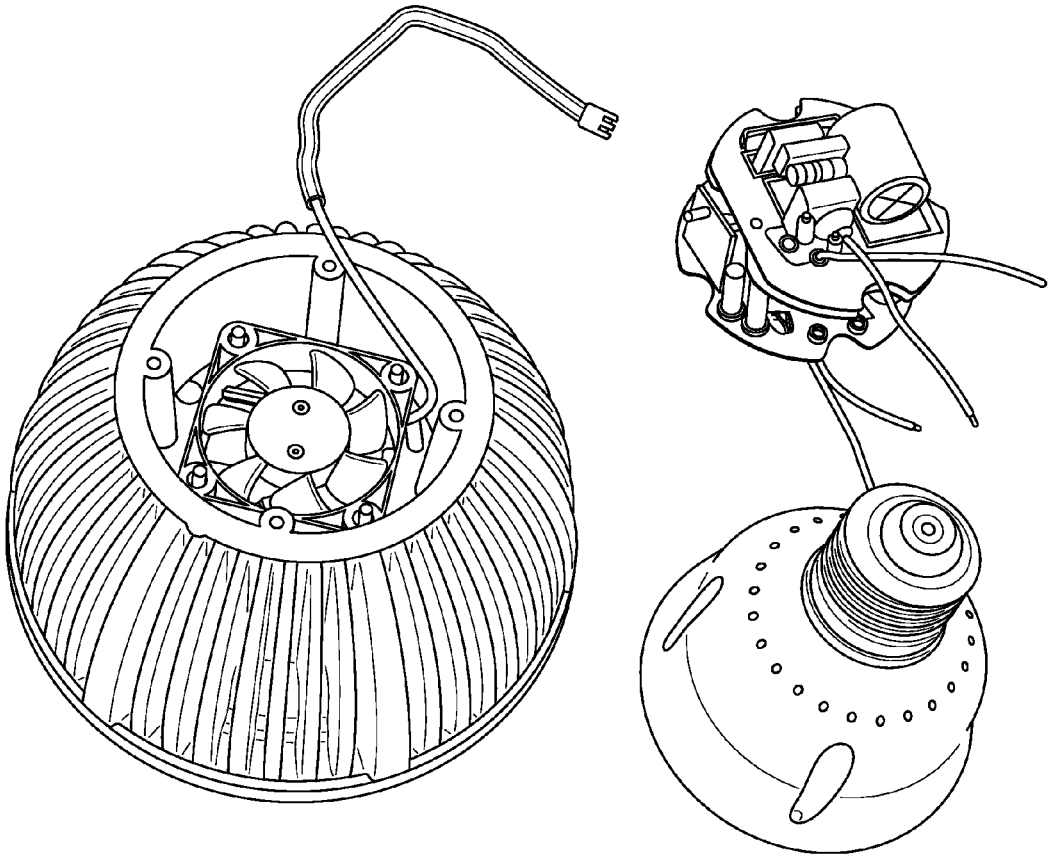
FIG. 8 is an exploded parts diagram view of an LED bulb according to an embodiment.

FIG. 8 depicts an exploded part view diagram of LED bulb 100 according to an embodiment with driver 204 removed from base 104. Fan 202 is mounted within housing 102 and the single plug connection from the components of the housing is depicted extending out of the housing for connection with driver 204.

Figure 9:
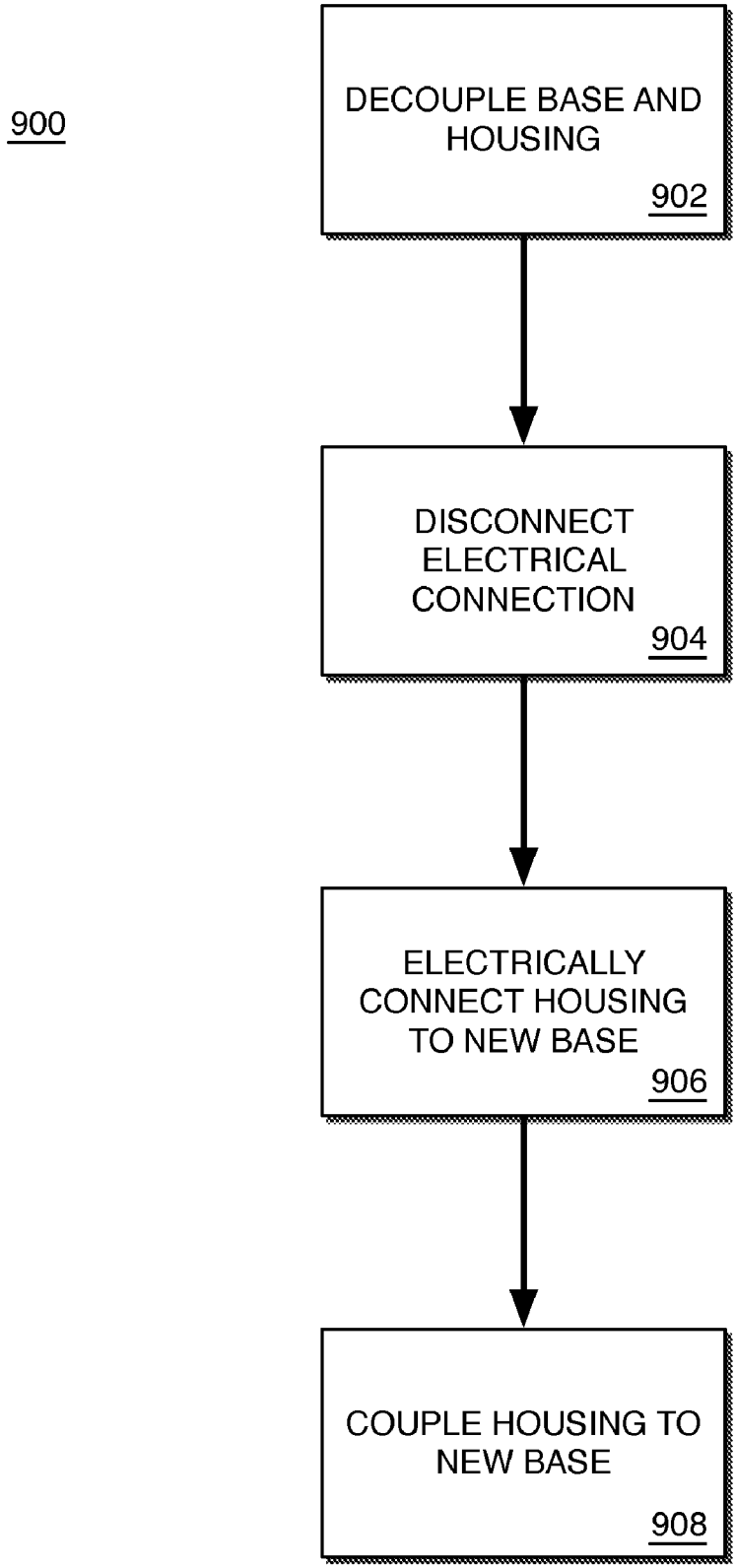
FIG. 9 is a high-level process flow diagram of a method according to an embodiment.

FIG. 9 depicts a high-level process flow of a method 900 for replacing a base 104 of an LED bulb 100. The flow begins at a decoupling step 902 wherein a user disconnects base 104 from housing 102. Next during electrical disconnect step 904, the user disconnects the electrical connection between base 104 and housing 102. In at least one embodiment, the user unplugs a single plug electrical connection connecting LED unit 200 and fan 202 with driver 204. In at least one embodiment, the user does not remove any thermal insulating and/or transfer material from LED bulb 100.

The flow proceeds to electrical connect step 906 wherein the user electrically connects a new base 104 to housing 102. For example, the user plugs the single plug electrical connection from housing 102 to driver 204 of the new base 104.

The flow proceeds to coupling step 908 wherein the user connects housing 102 to the new base 104.

Figure 10:
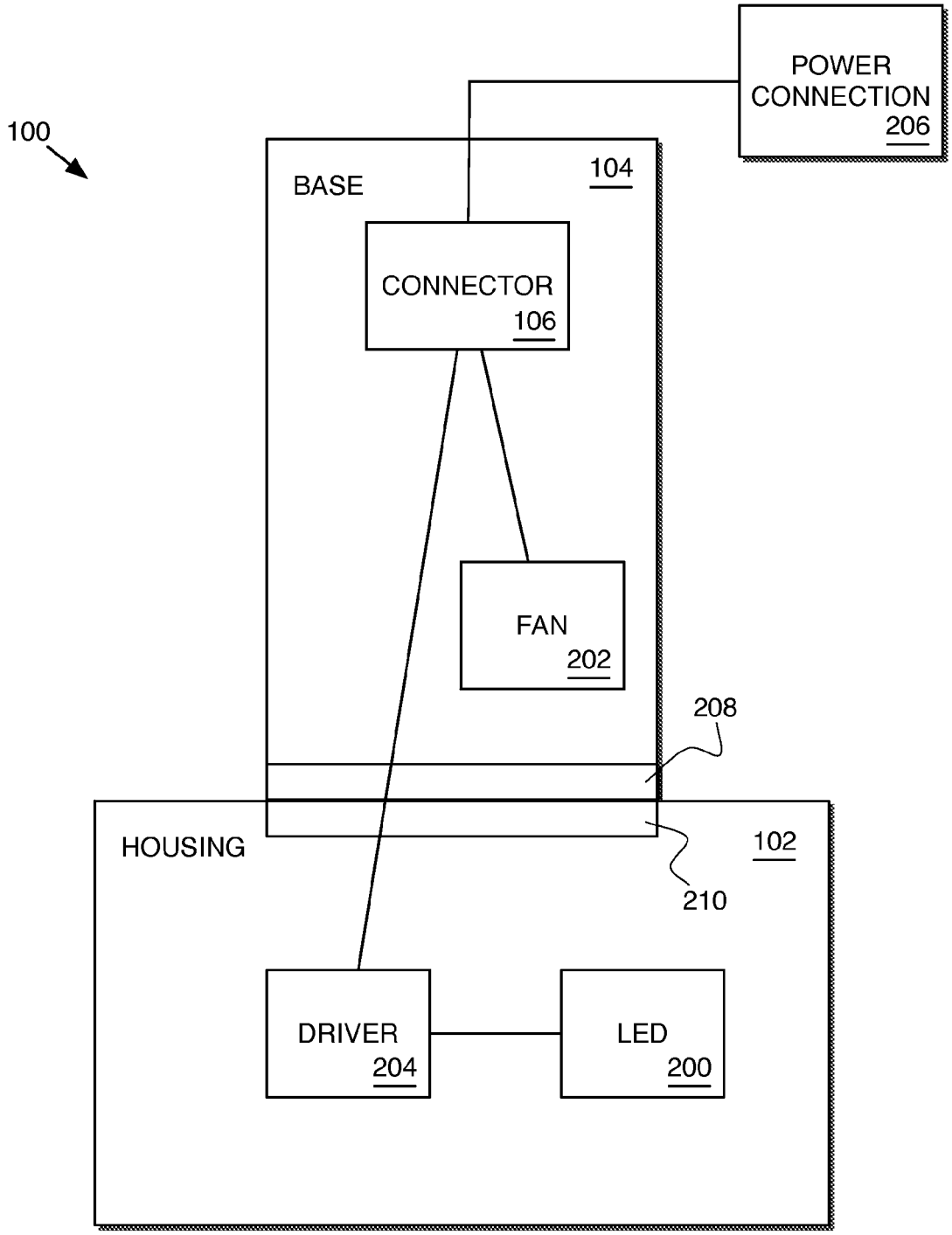
FIG. 10 depicts a high-level functional block diagram of an LED bulb according to another embodiment.

FIG. 10 depicts a high-level functional block diagram of LED bulb 100 according to another embodiment wherein fan 202 is positioned within base 104. In accordance with this embodiment, fan 202 may be directly connected with connector 106. In this manner, replacement of fan 202 may be performed without requiring replacement of housing 102 and/or components therein such as LED unit 200 or driver 204. In at least some embodiments, LED unit 200 may comprise driver 204 integrated therein.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

What is claimed is:

1. A light emitting diode-based bulb comprising:

a base having a base releasable attachment device, the base comprising:

a driver; and a housing having a housing releasable attachment device arranged to releasably couple the housing with the base via connection with the base releasable attachment device, the housing comprising:

a light emitting diode electrically connected to the driver; and a fan electrically connected to the driver, wherein the base including the driver is replaceable in its entirety by decoupling the base releasable attachment device from the housing releasable attachment device.

2. The light emitting diode-based bulb of claim 1, wherein the light emitting diode and the fan are electrically connected to the driver via a single electrical connection.

3. The light emitting diode-based bulb of claim 1, wherein the fan is configured to maintain the interior temperature of the bulb without the use of thermal transfer material.

4. The light emitting diode-based bulb of claim 1, wherein the base comprises a rear vent.

5. The light emitting diode-based bulb of claim 1, wherein the housing comprises a front vent.

6. The light emitting diode-based bulb as claimed in claim 1, wherein decoupling the housing module from the base module comprises decoupling the LED and fan from the driver.

7. The light emitting diode-based bulb of claim 1, wherein at least one of the base releasable attachment devices on the housing releasable attachment device is at least one of a screw, a bolt, a reverse threading, a clip, a portion of a twist-lock mechanism, or a portion of a bayonet mechanism.

8. A light emitting diode-based bulb comprising:

a base having a base releasable attachment device, the base comprising a power connector, a driver electrically coupled to the power connector, and a fan electrically coupled with the power connector; and a housing having a housing releasable attachment device arranged to releasably couple the housing with the base via connection with the base releasable attachment device, the housing comprising:

a light emitting diode electrically coupled with the power connector via the driver, wherein the base including the power connector, the driver, and the fan is replaceable in its entirety by decoupling the base releasable attachment device from the housing releasable attachment device.

9. The light emitting diode-based bulb of claim 8, wherein at least one of the base releasable attachment devices on the housing releasable attachment device is at least one of a screw, a bolt, a reverse threading, a clip, a portion of a twist-lock mechanism, or a portion of a bayonet mechanism.

10. A method of servicing a light-emitting diode-based bulb comprising:

decoupling a base releasable attachment device of a base and a housing releasable attachment device of a housing to thereby decouple the base, the base including a driver, from the housing, including a light emitting diode;

electrically disconnecting the decoupled base and housing, wherein electrically disconnecting the decoupled base and housing comprises electrically disconnecting the driver from the light emitting diode;

electrically connecting a new base and the housing; and coupling the new base, including a new driver, to the housing.

11. The method as claimed in claim 10 further comprising:

removing thermal insulating material from within the bulb after decoupling the base.

12. The method as claimed in claim 10, wherein electrically disconnecting the decoupled base and housing comprises electrically disconnecting a fan from a driver.

13. The method as claimed in claim 10, wherein electrically disconnecting the decoupled base and housing comprises electrically disconnecting a light emitting diode from a power connector.

14. The method as claimed in claim 10, wherein electrically disconnecting the decoupled base and housing comprises electrically disconnecting a fan from a power connector.

15. A light emitting diode-based bulb comprising:

a base having a base releasable attachment device, the base comprising:

a driver; and a housing having a housing releasable attachment device arranged to releasably couple the housing with the base via connection with the base releasable attachment device, the housing comprising:

a light emitting diode connected to the driver; and a cooling device connected to the driver, wherein decoupling the housing comprises decoupling at least the light emitting diode from the driver, wherein decoupling the base releasable attachment device from the housing releasable attachment device enables replacement of the base including the driver.

16. The light emitting diode-based bulb as claimed in claim 15, wherein at least one of the base or the housing comprises a vent.

17. The light emitting diode-based bulb as claimed in claim 15, further comprising a single connection electrically connects the light emitting diode and the cooling device to the driver.

18. The light emitting diode-based bulb of claim 15, wherein at least one of the base releasable attachment devices on the housing releasable attachment device is at least one of a screw, a bolt, a reverse threading, a clip, a portion of a twist-lock mechanism, or a portion of a bayonet mechanism.

* * * * *